US006386680B1

(12) United States Patent
Sharma et al.

(10) Patent No.: US 6,386,680 B1
(45) Date of Patent: May 14, 2002

(54) FLUID PUMP AND INK JET PRINT HEAD

(75) Inventors: Ravi Sharma, Fairport; Christopher N. Delametter, Rochester, both of NY (US)

(73) Assignee: Eastman Kodak Company, Rochester, NY (US)

( * ) Notice: Subject to any disclaimer, the term of this patent is extended or adjusted under 35 U.S.C. 154(b) by 0 days.

(21) Appl. No.: 09/677,532

(22) Filed: Oct. 2, 2000

(51) Int. Cl.[7] ..... B41J 2/14
(52) U.S. Cl. ..... 347/48
(58) Field of Search ..... 347/94, 15, 11, 347/48, 56, 54; 417/207, 208, 52

(56) References Cited

U.S. PATENT DOCUMENTS

| | | | | |
|---|---|---|---|---|
| 4,813,851 A | | 3/1989 | Chun et al. | |
| 4,908,679 A | | 3/1990 | Vora et al. | |
| 5,224,843 A | | 7/1993 | van Lintel | |
| 5,300,444 A | | 4/1994 | Hachisuka et al. | |
| 5,351,488 A | | 10/1994 | Sorensen | |
| 5,362,213 A | | 11/1994 | Komatsu et al. | |
| 5,499,909 A | | 3/1996 | Yamada et al. | |
| 5,507,601 A | | 4/1996 | Taguchi | |
| 5,578,526 A | | 11/1996 | Akram et al. | |
| 5,683,650 A | | 11/1997 | Morando | |
| 5,695,820 A | | 12/1997 | Davis et al. | |
| 5,850,241 A | * | 12/1998 | Silverbrook | 347/54 |
| 5,890,745 A | | 4/1999 | Kovacs | |
| 5,907,791 A | | 5/1999 | Cappuzzo et al. | |
| 5,963,235 A | | 10/1999 | Chwalek et al. | |
| 6,012,805 A | | 1/2000 | Hawkins et al. | |
| 6,126,270 A | * | 10/2000 | Lebens et al. | 347/48 |
| 6,231,177 B1 | * | 5/2001 | Cherukuri et al. | 347/105 |

FOREIGN PATENT DOCUMENTS

| | | | |
|---|---|---|---|
| JP | 363151459 | * | 6/1988 |
| JP | 403146349 | * | 6/1991 |

* cited by examiner

*Primary Examiner*—John Barlow
*Assistant Examiner*—Ly T Tran
(74) *Attorney, Agent, or Firm*—Norman Rushefsky

(57) ABSTRACT

A pump includes two opposing plates having a space there between to define a secondary fluid passage. A first aperture is formed through the first plate and a second aperture is formed in the second plate to define a primary fluid channel extending across the secondary fluid channel. A heater on the second plate moves primary fluid through the primary fluid channel due to the Marangoni type effect. A heater on the first plate causes a meniscus to enlarge to thereby form a drop of fluid ejected out of the primary fluid channel.

15 Claims, 5 Drawing Sheets

FLUID PUMP AND INK JET PRINT HEAD

FIELD OF THE INVENTION

The present invention relates generally to pumping devices, and more particularly to a fluid pump and ink jet print head using a temperature gradient across a multiple fluid interface to generate fluid motion.

BACKGROUND OF THE INVENTION

Various pumps are used in printers to pump ink out of a nozzle and onto a print medium. For example in a bubble jet printer, the ink in a channel is heated to a boil to create a bubble until the pressure ejects a droplet of the ink out of a nozzle. The bubble then collapses as the heating element cools, and the resulting vacuum draws fluid from a reservoir to replace the ink that was ejected from the nozzle. Such thermal technology requires a cooling period between ejecting successive droplets from a nozzle and thus has speed limitations. Also, such thermal technology cannot be used to pump fluids that are adversely affected by boiling.

Piezoelectric pumps, such as that disclosed in U.S. Pat. No. 5,224,843, have a piezoelectric crystal in the fluid channel that flexes when an electric current flows through it to force a drop of fluid out of a nozzle. Piezoelectric technology is faster and provides more control over the fluid movement as compared to thermal technology. Also, because the fluid to be pumped is not heated significantly, the fluid can be selected based on its relevant properties rather than its ability to withstand high temperatures. However, piezoelectric microscale pumps are complex and thus expensive to manufacture.

Further, fluid pumps are often required in various applications in which a high degree of control is required and high temperatures are to be avoided. For example, pumps can be used in biological heat-pipe type devices, devices which administer small doses of fluid into a larger stream of fluid, devices which pump various solutions that are unstable when boiled, devices which pump biological materials and other materials that must be maintained at a constant temperature, and other generic pumping applications.

It is well known to utilize the "Marangoni type effect" to pump fluids. The Marangoni type effect refers to a phenomenon that occurs at the interface of two immiscible fluids when the surface tension on the interface is not constant, i.e. has a gradient. In particular, a fluid flow is established along the fluid interface in the direction of increasing surface tension. Successive layers of the fluid below the interface are dragged along due to the viscosity of the fluid to establish a general current in the fluid in the direction of the Marangoni type flow. The surface tension gradient can be established by a temperature gradient along the interface because surface tension varies with temperature.

For example, U.S. Pat. No. 4,813,851 discloses a device for conveying fluids utilizing the Marangoni type effect. However, the device disclosed in U.S. Pat. No. 4,813,851 does not exhibit the high degree of control required for ink jet printers and other applications. Further, this device is not compatible with standard semiconductor fabrication techniques and thus is difficult to manufacture in small scale.

Accordingly, there is a need for a fluid pump, for use in printers or the like, that is simple in construction and capable of pumping fluid quickly and accurately without boiling the fluid.

SUMMARY OF THE INVENTION

An object of the invention is to increase the control accuracy of fluid pumps and print heads utilizing the thermally induced Marangoni type effect.

Another object of the invention is to simplify the construction of fluid pumps and print heads.

Another object of the invention is to impart motion to fluid without the need for moving parts or boiling of the fluid.

Another object of the invention is to utilize standard semiconductor fabrication techniques to manufacture a fluid pump and print head.

Another object of the invention is to improve the performance of ink jet print heads.

The invention achieves these and other objects through a first aspect of the invention which is an ink jet print head comprising a first plate having first and second sides and a first aperture formed therethrough, a second plate having first and second sides and a second aperture formed therethrough, and a spacer coupled to the second side of the first plate and the first side of the second plate to define a secondary fluid passage between the first plate and the second plate. The first aperture and the second aperture are substantially aligned to define an ink passage extending across the secondary fluid passage to thereby define an interface between ink in the ink passage and a secondary fluid in the secondary fluid passage. A first heater is disposed on the first side of the first plate proximate the first aperture, and a second heater is disposed on the first side of the second plate proximate the second aperture. A controller is operatively coupled to the first heater and the second heater to control energization of the first heater and the second heater in a predetermined manner. The interface is heated to create a temperature gradient, and thus a surface tension gradient, to thereby move ink through the ink passage.

A second aspect of the invention is a fluid pump comprising, a first fluid supply mechanism for supplying a primary fluid, a second fluid supply mechanism for supplying a secondary fluid, a first plate having first and second sides and a first aperture formed therethrough, a second plate having first and second sides and a second aperture formed therethrough and a spacer coupled to the second side of the first plate and the first side of the second plate to define a secondary fluid passage between the first plate and the second plate. The first aperture and the second aperture are substantially aligned to define a primary fluid passage extending across the secondary fluid passage. The primary fluid passage is coupled to the primary fluid supply and the secondary fluid passage is coupled to the secondary fluid supply to thereby define an interface between primary fluid in the primary fluid passage and secondary fluid in the secondary fluid passage. A first heater is disposed on said first side of the first plate proximate the first aperture and a second heater is disposed on the first side of the second plate proximate the second aperture. A controller is operatively coupled to the first heater and the second heater to control energization of the first heater and the second heater in a predetermined manner. Fluid is moved through the primary fluid passage due to the Marangoni type effect.

BRIEF DESCRIPTION OF THE DRAWINGS

Other features and advantages of the present invention will become apparent from the following description of the preferred embodiments of the invention and the accompanying drawings, wherein.

DETAILED DESCRIPTION OF THE INVENTION

Figure 1:
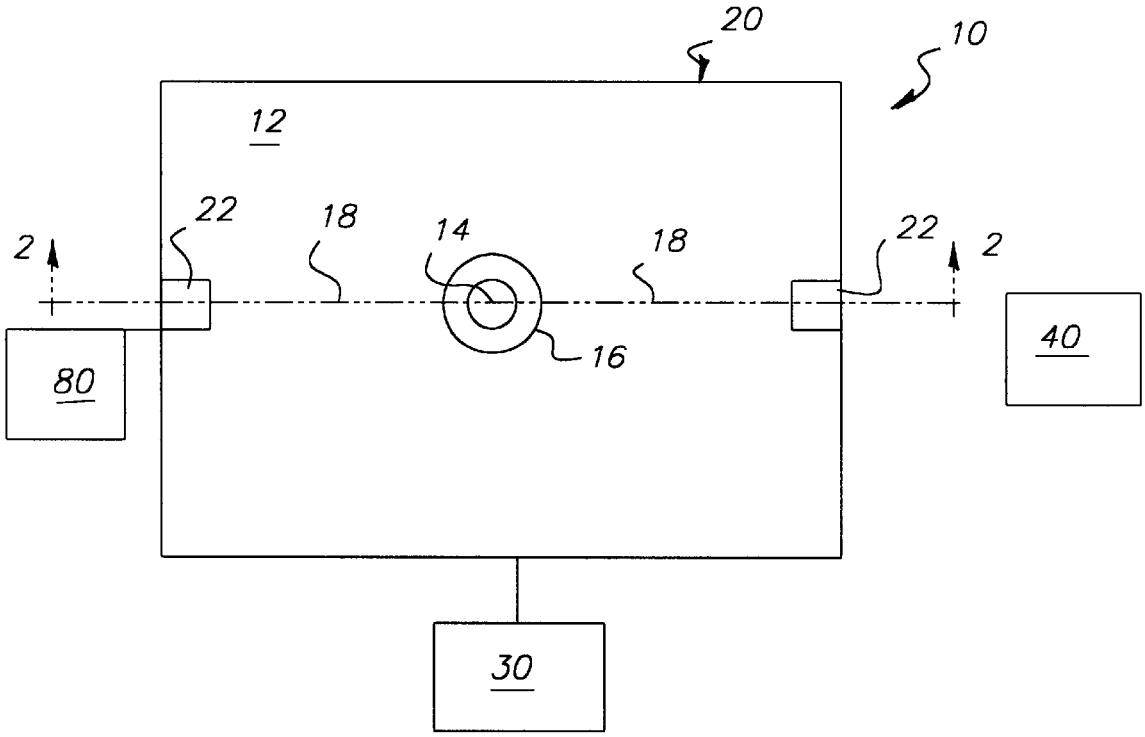
FIG. 1 is a top view of a pump in accordance with a preferred embodiment the invention.
Figure 2:
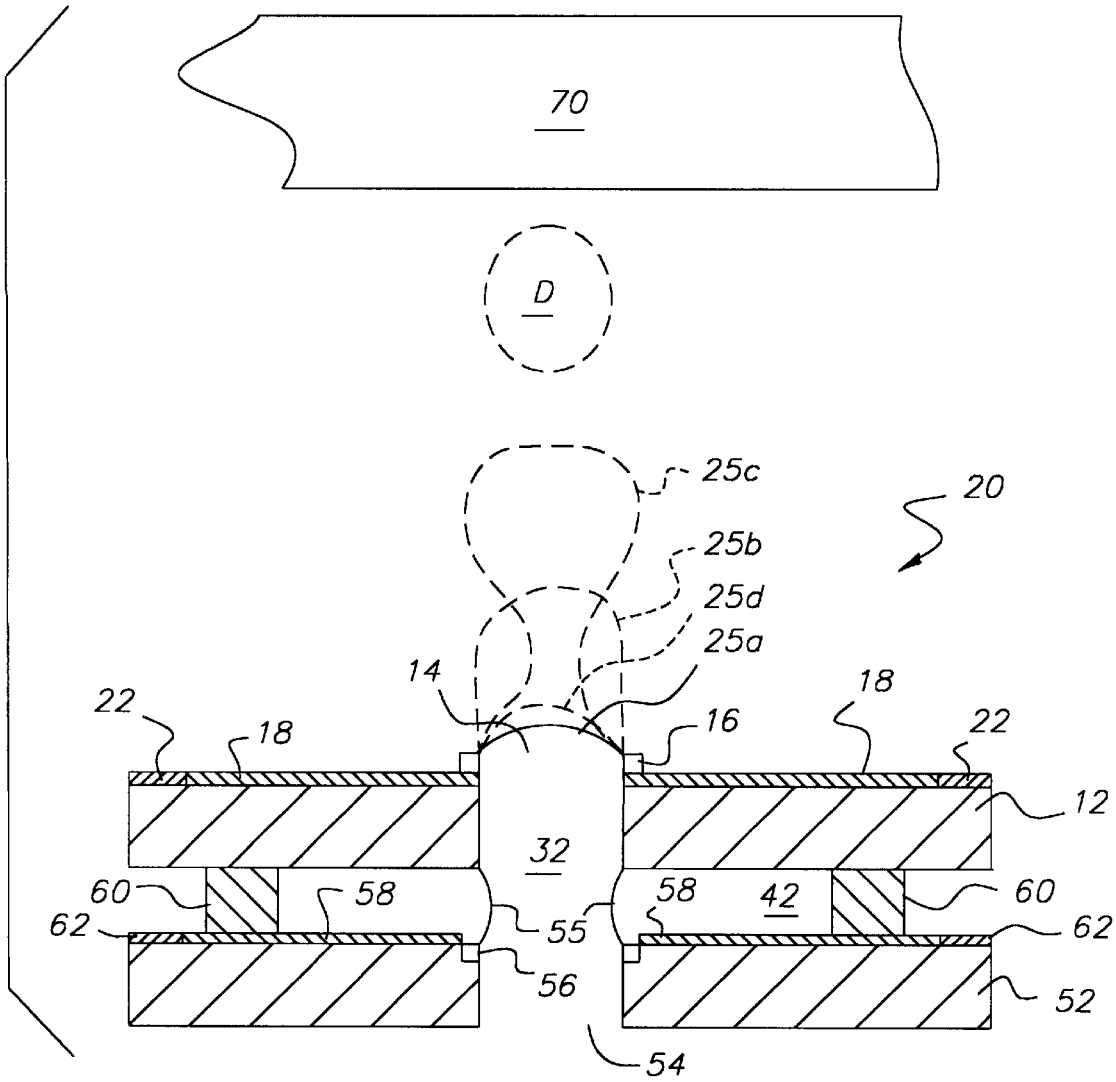
FIG. 2 is a sectional view of the head of the pump of FIG. 1 taken along line 2—2.

FIGS. 1 and 2 illustrate a first preferred embodiment of the invention in the form of a pump for an ink jet printer. The preferred embodiment is formed of a semiconductor material such as silicon using VLSI semiconductor fabrication techniques. However, the invention can be formed of various materials using various fabrication techniques. As illustrated in FIG. 1, pump 10 comprises head 20, primary fluid supply 30 (a supply of ink in the preferred embodiment), and secondary fluid supply 40 (a supply of air or any other suitable gas or liquid that is immiscible with respect to the primary fluid). Note that pump 10 is illustrated schematically and not to scale for the sake of clarity. However, one of ordinary skill in the art will be able to readily determine the specific size and interconnections of the elements of the preferred embodiment based on the disclosure herein.

As illustrated in FIG. 2, head 20 comprises first plate 12 having first aperture 14 formed therethrough and second plate 52 having second aperture 54 formed therethrough. Spacer 60 is disposed between first plate 12 and second plate 52 abutting a second side of first plate 12 and a first side of second plate 52. A first side of first plate 12 opposes printing medium 70, such as paper, and a second side of second plate 52 faces downward in FIG. 2. First aperture 14 and second aperture 54 are substantially in alignment to define primary fluid passage 32 which is coupled to primary fluid supply 30 at the second side of second plate 52. Spacer 60 defines secondary fluid passage 42 between first plate 12 and second plate 52. Secondary fluid passage 42 is coupled to secondary fluid supply 40 through an unillustrated port formed in spacer 60, first plate 12, or second plate 52.

Heater 16, in substantially a ring shape, is formed on the first side of first plate 12 around first aperture 14, preferably in a concentric manner Note that heater 16 is illustrated in FIG. 1 as being disposed radially away from an edge of first aperture 14 for clarity. However, heater 16 preferably is disposed close to an edge of first aperture 14 as illustrated in FIG. 2. In the preferred embodiment, heater 16 comprises an electric resistive heating element and thus conductors 18 and pads 22 are formed on the first side of first plate 12 to permit electrical connection between controller 80 and heater 16. Controller 80 can be merely a power supply or can comprise logic for controlling pump 10 in a desired manner. For example, controller 80 can be a programmable microprocessor based device. Similarly, heater 56, in substantially a ring shape, is formed on the first side of second plate 52 around second aperture 54, preferably in a concentric manner. In the preferred embodiment, heater 56 comprises an electric resistive heating element and thus conductors 58 and pads 52 are formed on the first side of second plate 52 to permit electrical connection between controller 80 and heater 56.

In operation of pump 10, a primary fluid (ink in the preferred embodiment) is supplied at a predetermined pressure from primary fluid supply 30, through second aperture 54, to primary fluid passage 32. Also, a secondary fluid, that is immiscible with respect to the primary fluid, is supplied from secondary fluid supply 40 to secondary fluid channel 42. The relative pressures of the primary fluid and the secondary fluid are adjusted, using pressure regulators or the like, to create meniscus 25*a* at first aperture 14 and meniscus 55 at the interface of the primary fluid and the secondary fluid. When heaters 16 and 56 are energized, by applying an electric potential across pads 22 and pads 62 respectively, the primary fluid will flow out of primary fluid passage 32 to create meniscus 25*b*, and eventually meniscus 25*c*, due to the Marangoni type effect caused by the temperature gradient, and thus the surface tension gradient, established along the interface between the primary fluid and the secondary fluid at meniscus 55. Heaters 16 and 56 are then turned off at the appropriate time and the primary fluid continues to move due to inertia to create meniscus 25*c*. Ultimately, drop D of primary fluid separates from the remaining primary fluid in primary fluid passage 32 leaving meniscus 25*d* that returns to the equilibrium shape of 25*a*.

Heater 16 causes meniscus 25*a* to bulge into meniscus 25*b* and so on, while heater 56 causes flow of primary fluid through primary fluid passage 32 due to the Marangoni type affect across the interface between the primary fluid and the secondary fluid, i.e. meniscus 55. This procedure is accomplished for each drop of primary fluid to be ejected from primary fluid passage 32. For example, in the case of an ink jet printer, controller 80 controls the timing of energizing heaters 16 and 56, and possibly the pressure of the primary fluid and the secondary fluid, to eject drops D for forming a desired image on print medium 70.

Figure 3:
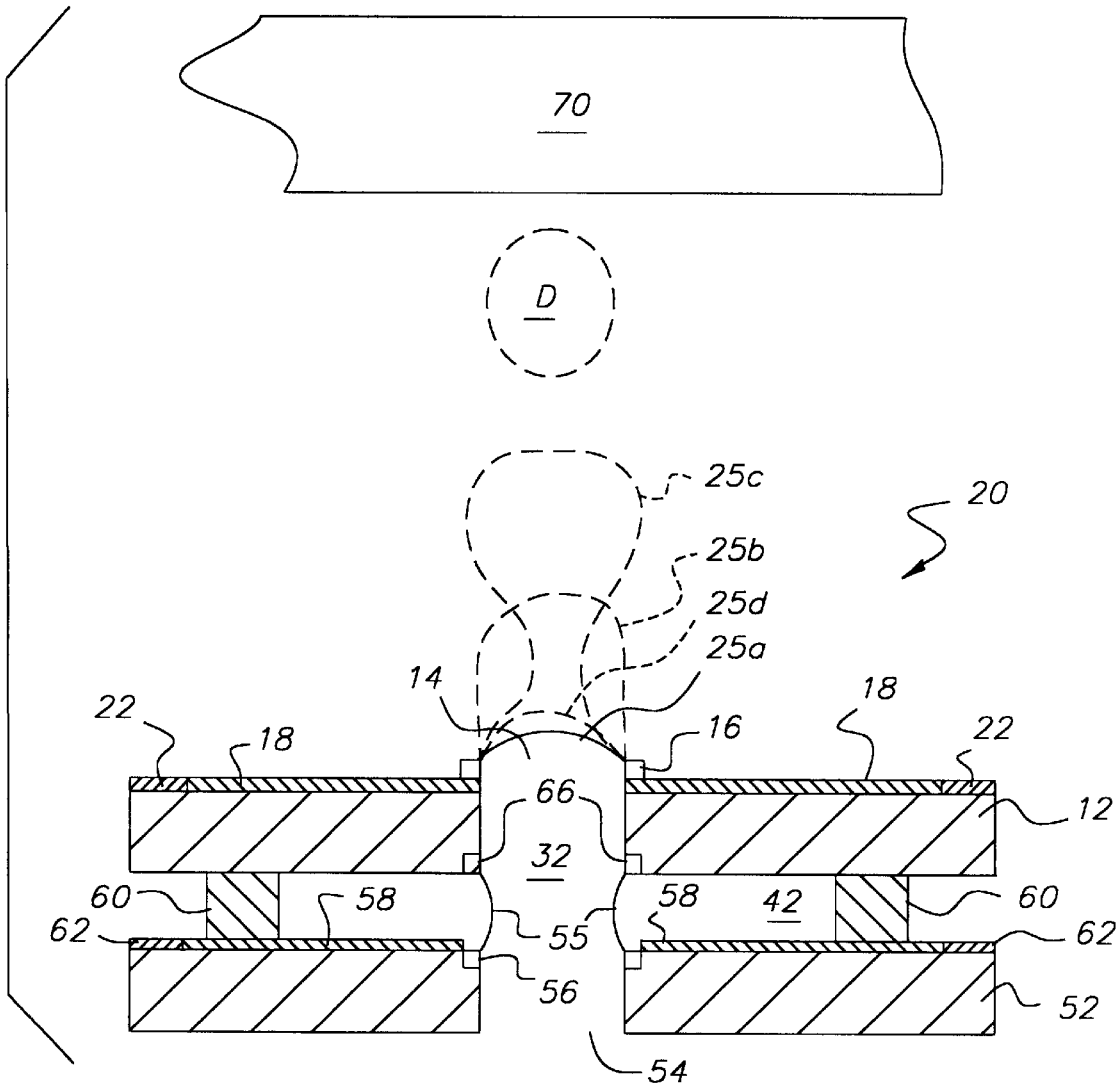
FIG. 3 is a sectional view taken along line 2—2 of the head of the pump of FIG. 1 with a first modification.

FIG. 3 illustrates a modification of head 10 of the preferred embodiment. Specifically, head 10 further includes heater 66 formed on a second side of first plate 12 concentrically around first aperture 14, Heater 66 which permits flow of primary fluid through primary fluid passage 32 to be reversed. Heaters 16 and 56 are energized in the manner described above to begin to form drop D. However, when meniscus 25*a–c* is sufficiently extended, heaters 16 and 56 are turned off and heater 66 is energized by controller 80 to reverse flow of the primary fluid, due to the Marangoni type effect, and more reliably separate drop D from the remaining primary fluid in primary fluid passage 32.

Figure 4:
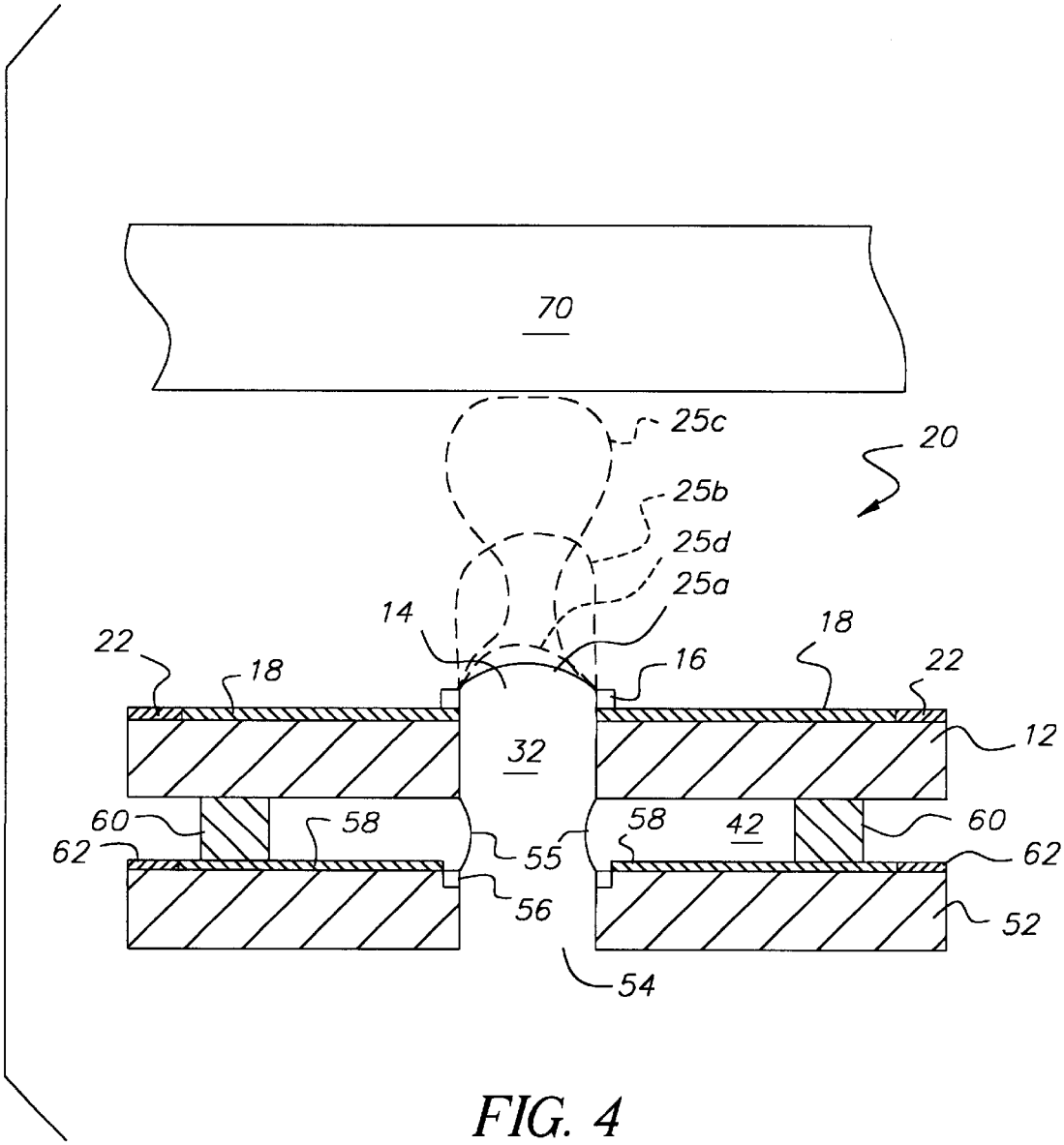
FIG. 4 is a sectional view, taken along line 2—2, of the head of the pump of FIG. 1 used in a modified manner.

FIG. 4 illustrates another modification of the preferred embodiment. In FIG. 4, head 10 is operated to cause meniscus 25*c* to contact recording medium 70 and separate from the remaining primary fluid due to wetting of recording medium 70. The modification of FIG. 4 can be achieved merely by placing recording medium closer to head 10 or by adjusting the operating parameters of head 10, such as the dimensions of head 10, the pressures of the primary and secondary fluids, the operation of the heaters, and the like. The modification of FIG. 4 can be achieved with the structure of head 10 illustrated in FIG. 2 or FIG. 3.

Figure 5:
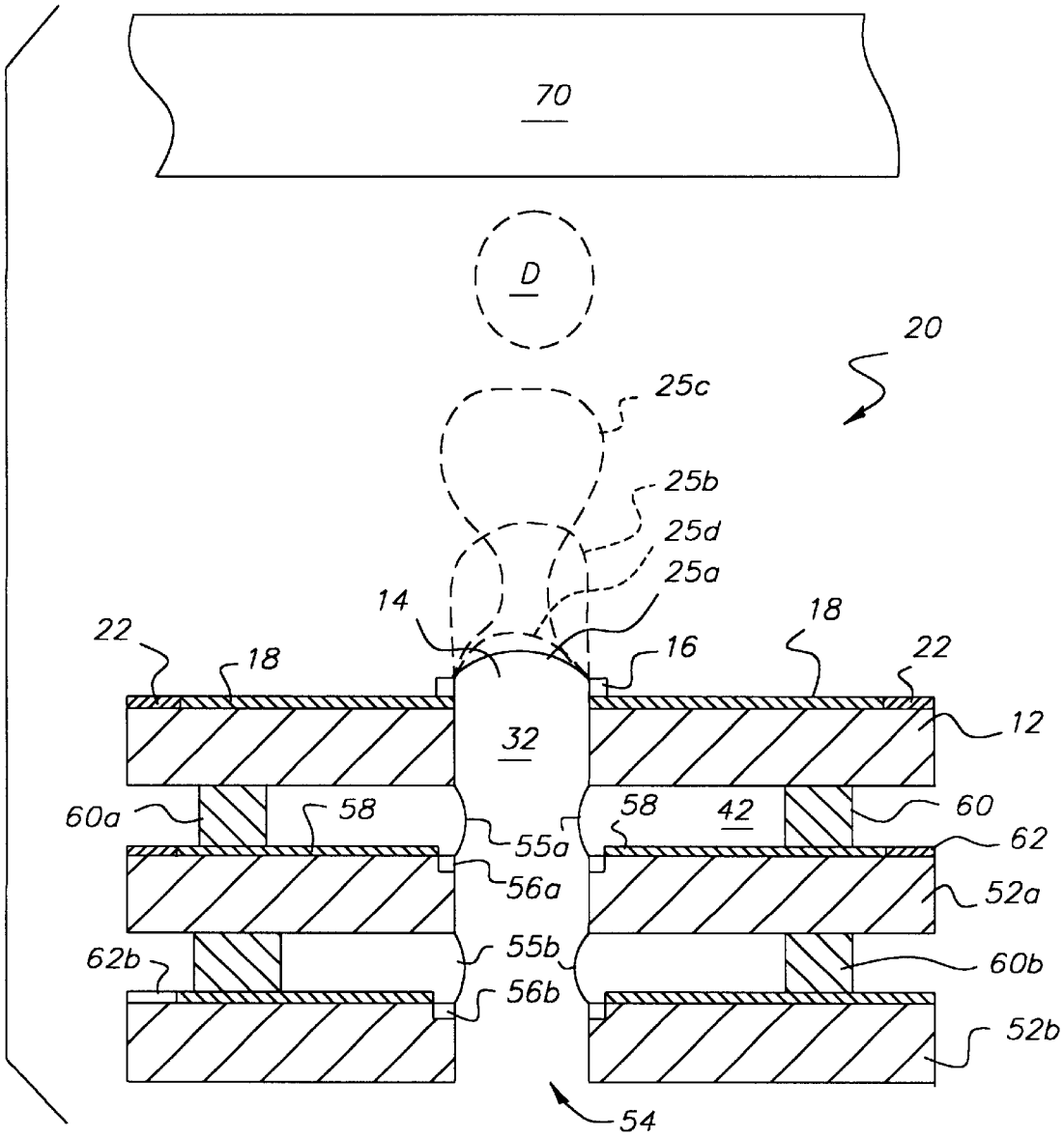
FIG. 5 is a sectional view of the head of a pump in accordance with another preferred embodiment.

FIG. 5 illustrates another preferred embodiment having multiple stages for creating the thermally driven Marangoni type effect. Specifically, heat can be applied to meniscuses 55*a* and 55*b* by heating elements 56*a* and 56*b*, as a second heater, to propel fluid through fluid passage 32. Otherwise operation of this embodiment is similar to that of the embodiment of FIG. 1. Similar elements in FIG. 5 are labeled with like reference numerals as compared to FIG. 1. However, the suffixes "a" and "b" are used to differentiate between Marangoni type effect stages.

The primary fluid can be any fluid that is to be pumped, such as a liquid or gas. The secondary fluid can be any fluid that is immiscible with respect to the primary fluid and presents an interface with the primary fluid having the desired surface tension and other properties. The secondary fluid can be selected based on the primary fluid, the pump structure, and other considerations of each application.

The pump can be constructed using standard semiconductor fabrication techniques. The pump can be formed using silicon substrates as the plates or using any other material. The heaters, pads, and conductors can be formed and patterned through vapor deposition and lithography techniques. The pump can be of any size and the components thereof can have various relative dimensions. Accordingly, the pump can be a microscale pump or a larger or smaller device. The heating elements can be any type of energy delivery device, such as resistive heaters, radiation heaters, convection heaters, chemical reaction heaters (endothermic or exothermic), nuclear reaction heaters, or the like. The pump can be controlled in any appropriate manner. The controller can be of any type, such as with a microprocessor based device having a predetermined program. The heating elements can be energized to provide a desired temperature gradient in any manner and with any scheme of time coordination. For example, the heating elements can be controlled by adjusting the current therethrough or by intermittent activation in a predetermined manner. Each heater can include one heating element or plural heating elements. The pump can be applied to pumping of various fluids, such as ink in a print head, biological materials, medicaments, or any other fluids. Any number of Marangoni type effect stages can be used in seriatim or in a parallel configuration.

While the foregoing description includes many details and specificities, it is to be understood that these have been included for purposes of explanation only, and are not to be interpreted as limitations of the present invention. Many modifications to the embodiments described above can be made without departing from the spirit and scope of the invention, as is intended to be encompassed by the following claims and their legal equivalents.

PARTS LIST

10 Pump
12 First Mate
14 First Aperture
16 First Heater
18 Conductor
20 Head
22 Pads
25 and Meniscus
30 Primary Fluid Supply
32 Primary Fluid Passage
40 Secondary Fluid Supply
42 Secondary Fluid Passage
52 Second Plate
54 Second Aperture
55 Meniscus
56 Second Heater
58 Conductor
60 Spacer
62 Pad
70 Print Medium

What is claimed is:

1. An ink jet print head comprising:

a first plate having first and second sides and a first aperture formed therethrough;

a second plate having first and second sides and a second aperture formed therethrough;

a spacer coupled to said second side of said first plate and said first side of said second plate to define a secondary fluid passage between said first plate and said second plate with said first aperture and said second aperture being substantially aligned to define an ink passage extending across said secondary fluid passage to thereby define an interface between ink in said ink passage and a secondary fluid in said secondary fluid passage;

a first heater disposed on said first side of said first plate proximate said first aperture;

a second heater disposed on said first side of said second plate proximate said second aperture; and a controller operatively coupled to said first heater and said second heater to control energization of said first heater and said second heater in a predetermined manner.

2. An ink jet print head as recited in claim 1, wherein said controller is configured to energize said second heater to create a temperature gradient along the interface between ink in said ink passage and the secondary fluid in said secondary fluid passage and thereby cause ink to flow in a first direction through said ink passage and out of said first aperture and to energize said first heater in concert with said second heater to separate a meniscus of the ink extending out of said ink passage to define a drop of ink.

3. An ink jet print head as recited in claim 2, wherein said first heater and said second heater each comprise a resistive heating element.

4. An ink jet printer as recited in claim 2, wherein said first heater comprises a ring shaped heating element disposed in a concentric manner with respect to said first aperture and said second heater comprises a ring shaped heating element disposed in a concentric manner with respect to said second aperture.

5. An ink jet printer as recited in claim 2, further comprising a third heater disposed on said second side of said first plate proximate said first aperture and wherein said controller is operatively coupled to said third heater to control energization of said third heater in concert with said first heater and said second heater to thereby cause ink to flow in a second direction opposite to the first direction through said ink passage.

6. An ink jet printer as recited in claim 2, wherein said print head is configured to be disposed proximate a print medium whereby the meniscus is separated in part due to forces due to wetting of the print medium.

7. An ink jet printer as recited in claim 1, wherein said second heater comprises plural heating elements proximate the interface between ink in said ink passage and secondary fluid in said fluid passage.

8. An ink jet printer as recited in claim 7, wherein said heating elements are disposed in seriatim along said ink passage to define plural stage in said ink passage.

9. A pump as recited in claim 8, wherein said first heater and said second heater each comprise a resistive heating element.

10. A pump as recited in claim 8, wherein said first heater comprises a ring shaped heating element disposed in a concentric manner with respect to said first aperture and said second heater comprises a ring shaped heating element disposed in a concentric manner with respect to said second aperture.

11. A pump as recited in claim 8, further comprising a third heater disposed on said second side of said first plate proximate said first aperture and wherein said controller is coupled to said third heater to control energization of said third heater in concert with said first heater and said second heater to cause the primary fluid to flow in a second direction opposite to the first direction through said primary fluid passage.

12. A pump as recited in claim 7, wherein said controller is configured to energize said second heater to create a temperature gradient along the interface between the primary fluid and the secondary fluid and cause the primary fluid to flow in a first direction through said primary fluid passage and out of said first aperture and to energize said first heater in concert with said second heater to enlarge a meniscus of the primary fluid extending out of said primary fluid passage to define a drop of primary fluid.

13. A fluid pump comprising:

a first fluid supply mechanism for supplying a first fluid;

a second fluid supply mechanism for supplying a second fluid;

a first plate having first and second sides and a first aperture formed therethrough;

a second plate having first and second sides and a second aperture formed therethrough;

a spacer coupled to said second side of said first plate and said first side of said second plate to define a secondary fluid passage between said first plate and said second plate, said first aperture and said second aperture being substantially aligned to define a primary fluid passage extending across said second fluid passage, said primary fluid passage being coupled to said primary fluid supply and said second fluid passage being coupled to said secondary fluid supply passage to thereby define an interface between a primary fluid in said primary fluid passage and a secondary fluid in said secondary fluid passage;

a first heater disposed on said first side of said first plate proximate said first aperture; and a second heater disposed on said first side of said second plate proximate said second aperture; and a controller operatively coupled to said first heater and said second heater to control energization of said first heater and said second heater in a predetermined manner.

14. A pump as recited in claim 9, wherein said second heater comprises plural heating elements proximate the interface between the primary fluid and the secondary fluid.

15. A pump as recited in claim 14, wherein said heating elements are disposed in seriatim along said primary fluid passage to define plural stages.

* * * * *